US012577835B1

(12) United States Patent
Haas et al.

(10) Patent No.: US 12,577,835 B1
(45) Date of Patent: Mar. 17, 2026

(54) MOBILE CORING MACHINE WITH ADJUSTABLE MAST

(71) Applicant: Utilicor Technologies Inc., Toronto (CA)

(72) Inventors: Jeffrey Haas, Toronto (CA); Andrew Leslie Pollock, Toronto (CA)

(73) Assignee: UTILICOR TECHNOLOGIES INC., Toronto (CA)

( * ) Notice: Subject to any disclaimer, the term of this patent is extended or adjusted under 35 U.S.C. 154(b) by 0 days.

(21) Appl. No.: 19/097,958

(22) Filed: Apr. 2, 2025

(51) Int. Cl.
*E21B 7/02* (2006.01)

(52) U.S. Cl.
CPC ..... *E21B 7/027* (2013.01)

(58) Field of Classification Search
CPC ..... E21B 7/027; E21B 7/028
See application file for complete search history.

(56) References Cited

U.S. PATENT DOCUMENTS

| | | | | |
|---|---|---|---|---|
| 7,757,780 | B2 | 7/2010 | Pollock et al. | |
| 8,327,950 | B2 | 12/2012 | Pollock et al. | |
| 9,856,698 | B2 | 1/2018 | Pollock et al. | |
| 12,031,432 | B2 | 7/2024 | Pollock et al. | |
| 2021/0008647 | A1* | 1/2021 | Carlson | F16M 11/18 |
| 2021/0372201 | A1* | 12/2021 | Pollock | E21B 7/02 |
| 2024/0026746 | A1* | 1/2024 | West | E21B 19/086 |
| 2024/0247546 | A1* | 7/2024 | Garrett | E21B 25/00 |
| 2024/0367308 | A1* | 11/2024 | Gottschling | B25H 1/0042 |

* cited by examiner

*Primary Examiner* — Giovanna Wright
(74) *Attorney, Agent, or Firm* — Smart & Biggar LP

(57) ABSTRACT

A mobile coring apparatus includes a machine frame including a mount, a mast pivotally connected to the mount and a coring assembly coupled to the mast. The coring assembly is configured to drive a core bit for coring through a surface. The pivotable mast allows for the core bit to remain perpendicular with the horizon when the mobile coring apparatus is used on an angled surface.

16 Claims, 16 Drawing Sheets

MOBILE CORING MACHINE WITH ADJUSTABLE MAST

FIELD

The present disclosure relates to excavating apparatuses for coring or drilling concrete or paved ground surfaces.

INTRODUCTION

The following paragraphs are not an admission that anything discussed in them is prior art or part of the knowledge of persons skilled in the art.

Coring machines are used in various industries for drilling into hard surfaces like concrete or asphalt. Typically, a hollow core bit is used that removes a cylindrical core from the material. Such holes may allow for access to infrastructure buried below the ground. In addition, the removed core may be saved and put back into place once the underground work is completed (i.e. reinstated).

In certain circumstances, a coring machine may be needed on uneven surfaces. For example, roads are often angled to allow for surface water to run-off. However, the core bit must remain generally vertical, i.e. perpendicular to the horizon (and not perpendicular to the angled surface), to neutralize the effect of gravity on both the coring and reinstatement processes. If a core was cut perpendicular to the angled surface, one side would be lower and affected by gravity more than the other and the core itself would not have vertical sides. This could lead to a bonding compound used during reinstatement to pool to the lower side or cause the drum of the core bit to become stuck as it is driven into the ground.

Accordingly, there is a need for a mobile coring apparatus that may be used on an angled surface and allow for the core bit to remain perpendicular to the horizon.

SUMMARY

The following paragraphs are intended to introduce the reader to the more detailed description that follows and not to define or limit the claimed subject matter.

The present disclosure provides a mobile coring apparatus, including: a machine frame including a mount; a mast pivotally connected to the mount; and a coring assembly coupled to the mast, the coring assembly configured to drive a core bit for coring through a surface.

The mast can be configured to pivot relative to the mount between a forward position and a rearward position. The mast can extend from a mast top end to a mast lower end, and the mast can be pivotally connected to the mount towards the mast lower end.

The apparatus can include an angular adjustment mechanism that can permit the mast to pivot between the forward and rearward positions and can lock the mast in place relative to the mount. The angular adjustment mechanism can be operable to lock the mast in the forward position, the rearward position, and an intermediate position, wherein, in the intermediate position, an axis extending from a core bit top end to a core bit lower end is generally vertical to the surface. The angular adjustment mechanism can include a side plate that extends horizontally outwardly from one of the mast and mount.

The angular adjustment mechanism can include a locking mechanism mounted to the other of the mast and mount that locks the other of the mast and mount to the side plate. The locking mechanism can include an arcuate slot in the side plate for receiving a clamping mechanism. The clamping mechanism can include a toggle clamp or a clamp tube.

The mast can extend from a mast top end to a mast lower end, and the angular adjustment mechanism secures the mast in place towards the mast top end.

The angular adjustment mechanism can include a pivot wheel assembly, the pivot wheel assembly including: a pivot rod extending between the mast and the mount; and a pivot wheel operable to rotate the pivot rod, wherein the rotation of the pivot rod pivots the mast about the mount.

The mast can be pivotably connected to the mount using one of a shoulder socket screw, a pin or a hinge.

The mast can include at least one rail that permits the coring assembly to be displaced upwardly and downwardly relative to the surface between a raised position and a lowered position. The mast can include two rails that are parallel to one another. The mast can include a bed that is slidingly mounted to the rails and the coring assembly is fixed to the bed. The apparatus can include a motor for displacing the coring assembly along the at least one rails.

The apparatus can be self-propelled. The apparatus can include a mobility assembly coupled to the machine frame for moving the apparatus along the surface. The mobility assembly can include at least one track system. The apparatus can include an engine for propelling the mobile coring assembly and a remote control for controlling the magnitude and direction of the propulsion of the mobile coring apparatus.

Other aspects and features of the teachings disclosed herein will become apparent, to those ordinarily skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Various apparatuses or methods will be described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below, or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

Figure 1:
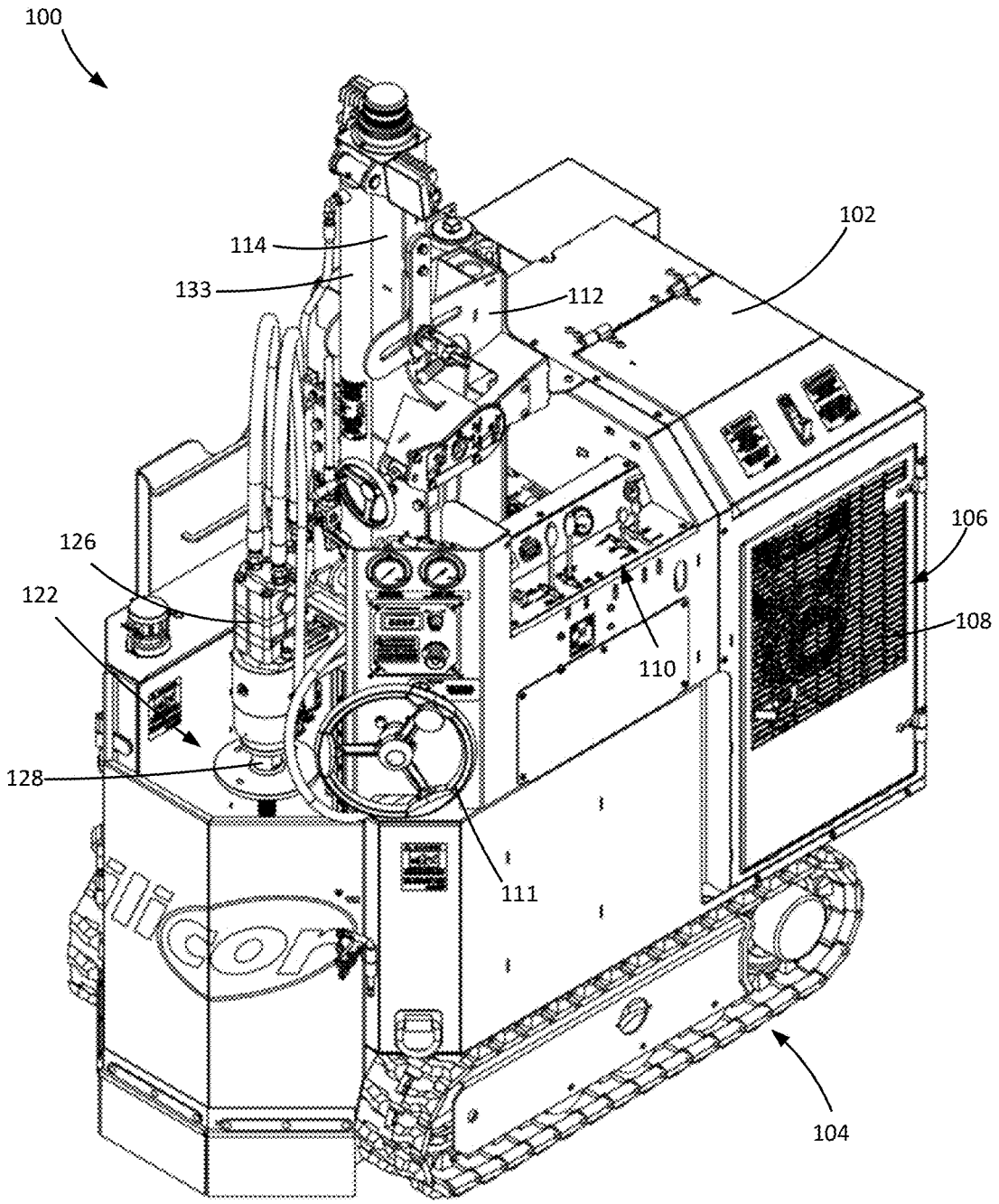
FIG. 1 is a front perspective view an exemplary mobile coring apparatus.
Figure 2:
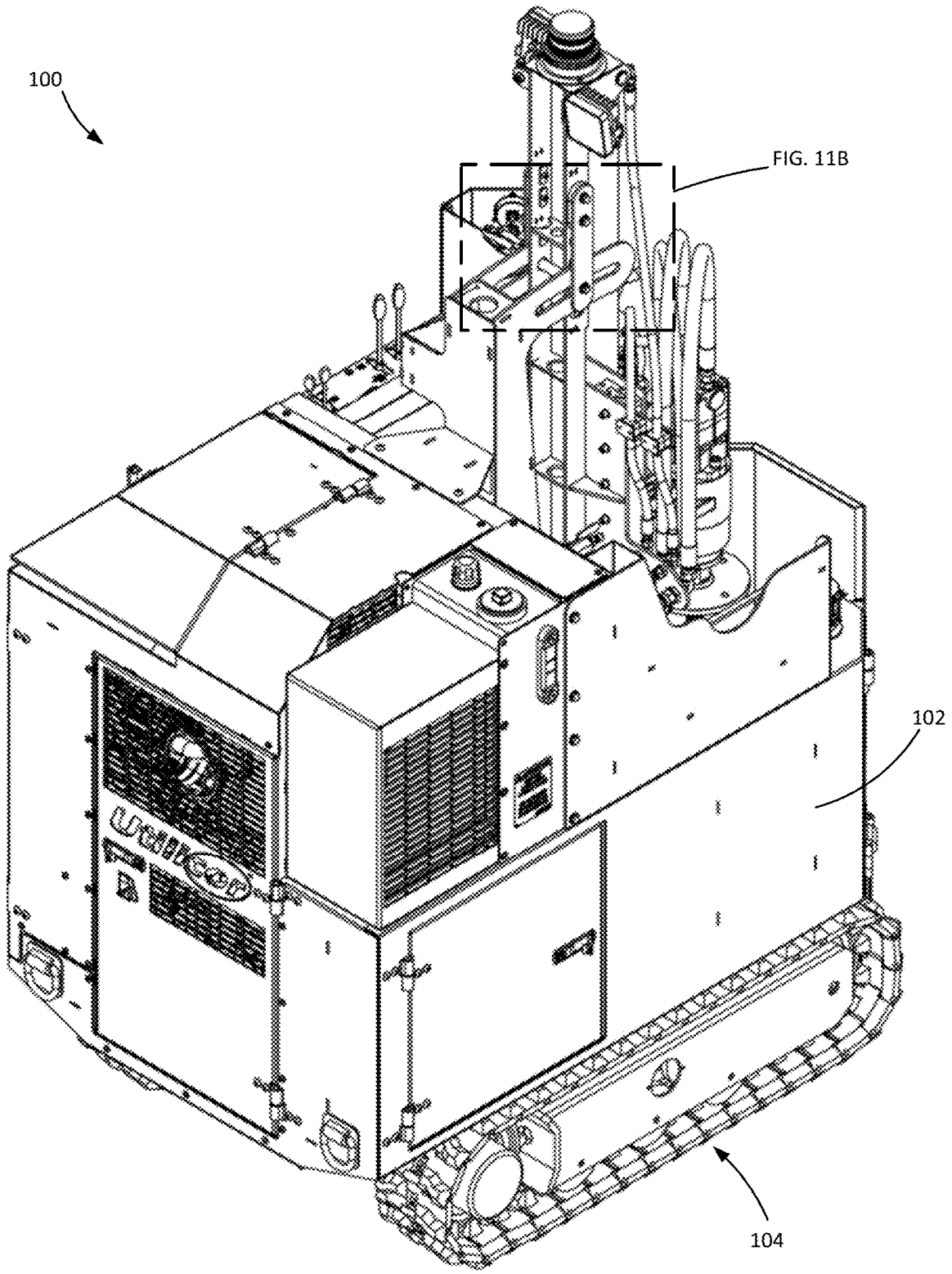
FIG. 2 is a rear perspective view of the apparatus of FIG. 1.
Figure 3:
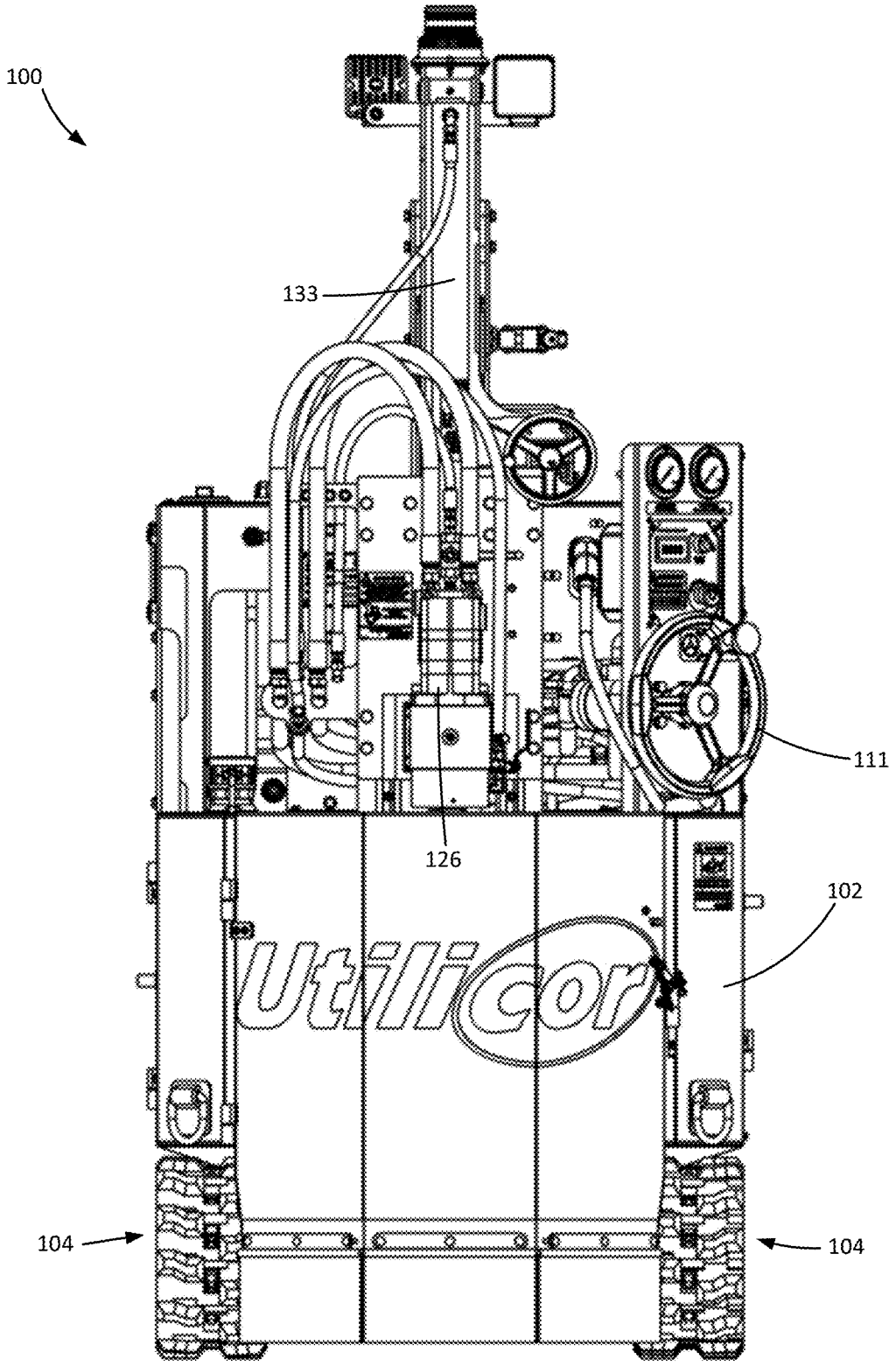
FIG. 3 is a front view of the apparatus of FIG. 1.
Figure 4:
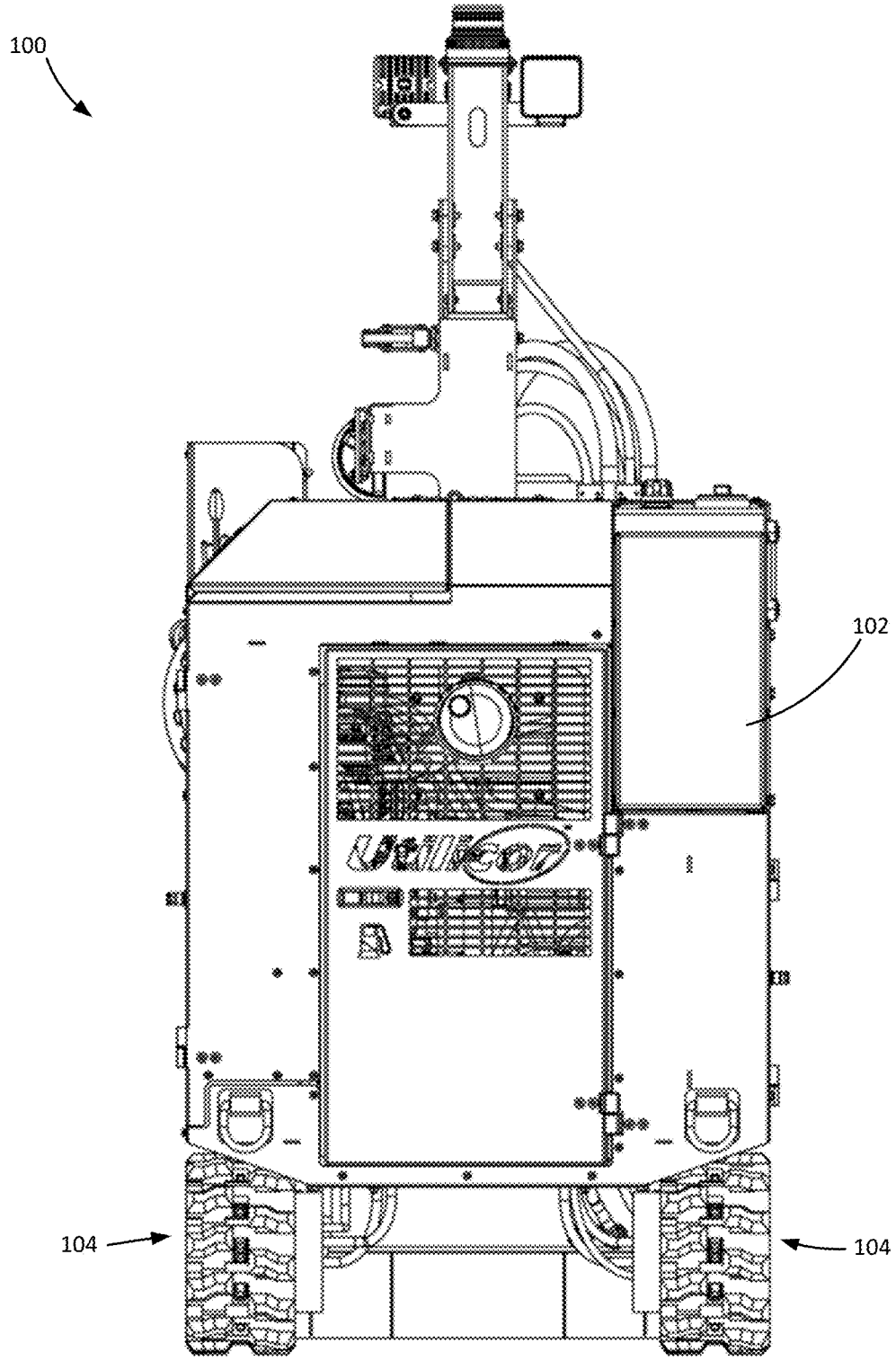
FIG. 4 is a rear view of the apparatus of FIG. 1.
Figure 5:
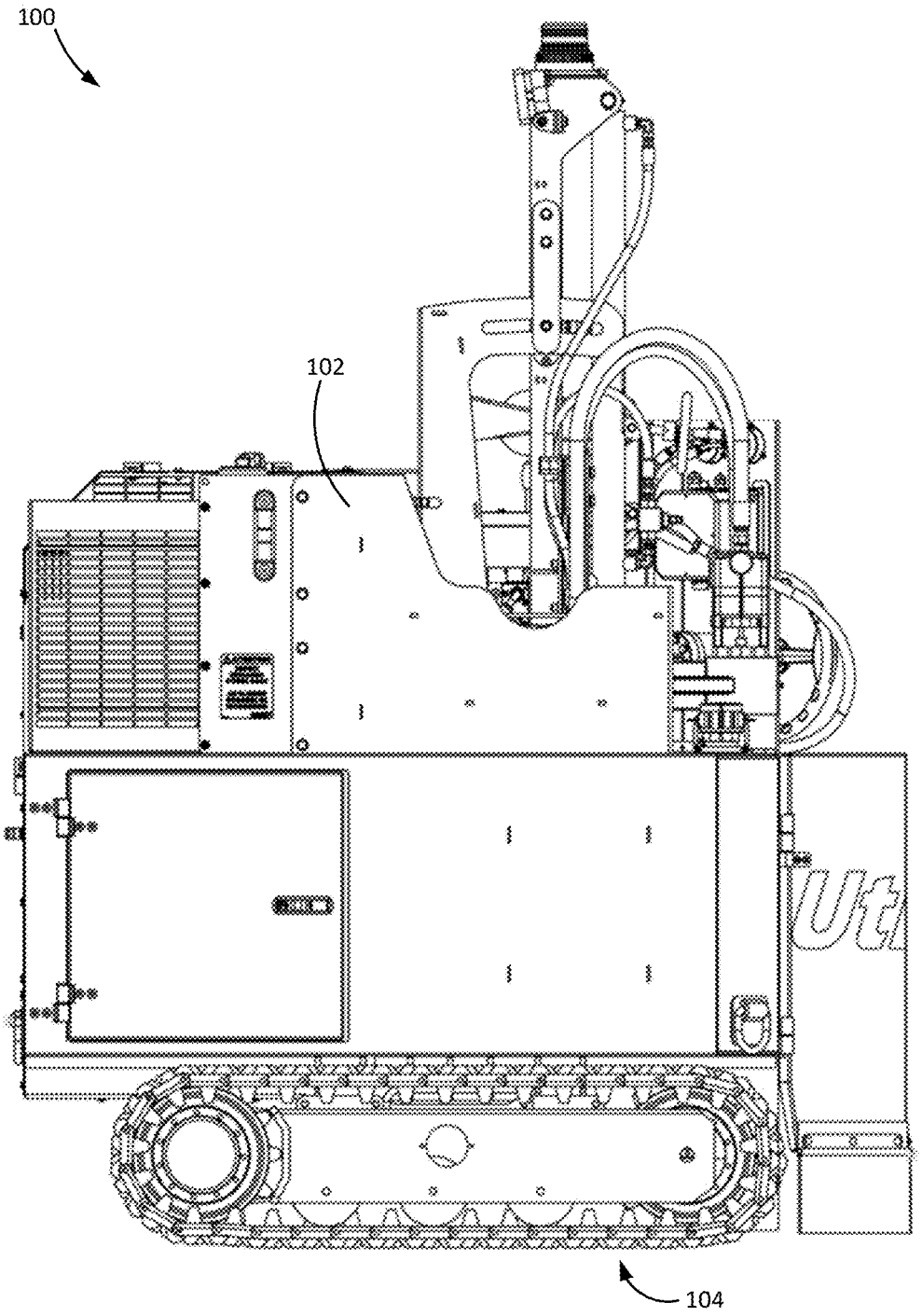
FIG. 5 is a left side view of the apparatus of FIG. 1.
Figure 6:
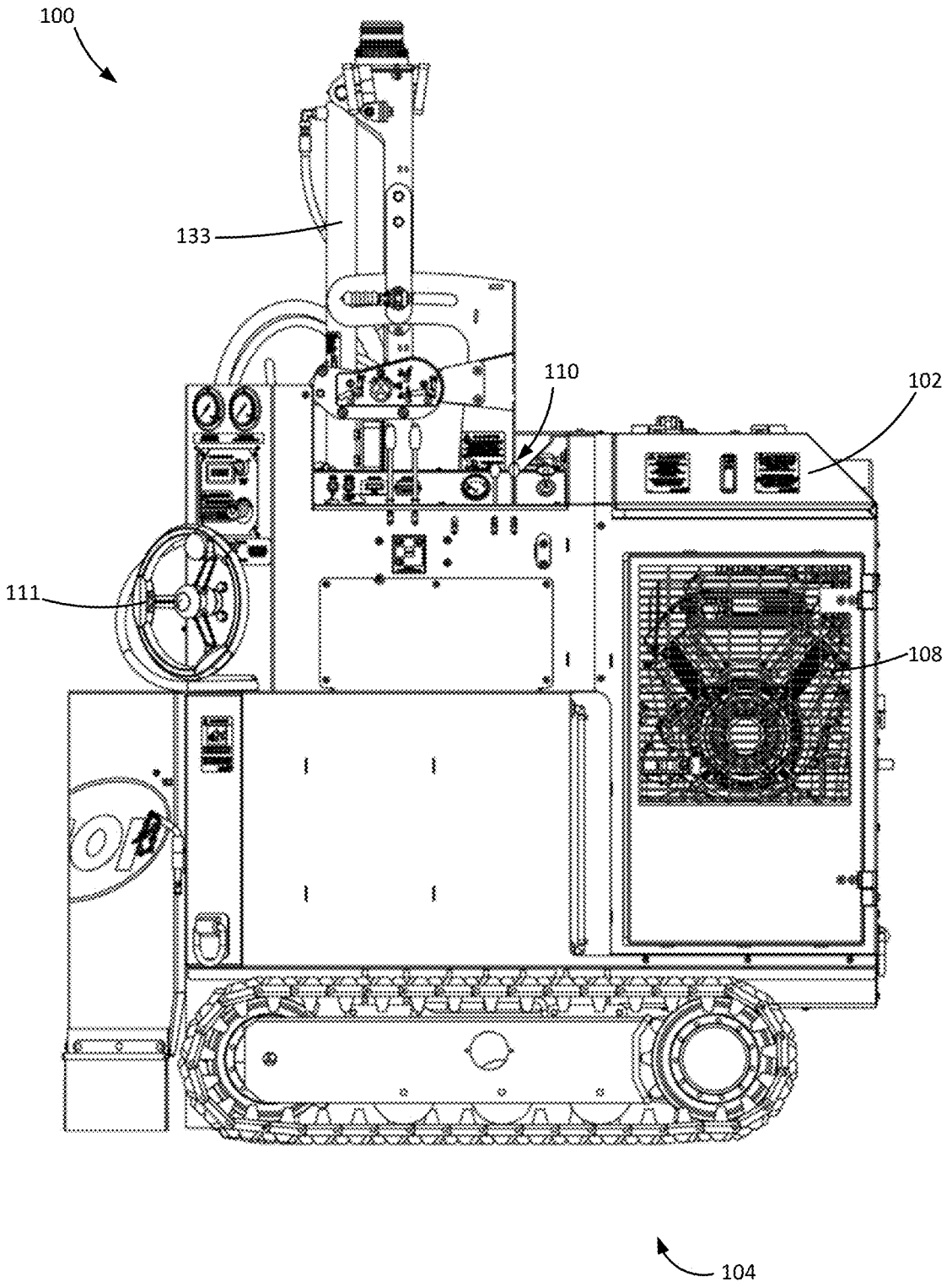
FIG. 6 is a right side view of the apparatus of FIG. 1.
Figure 7:
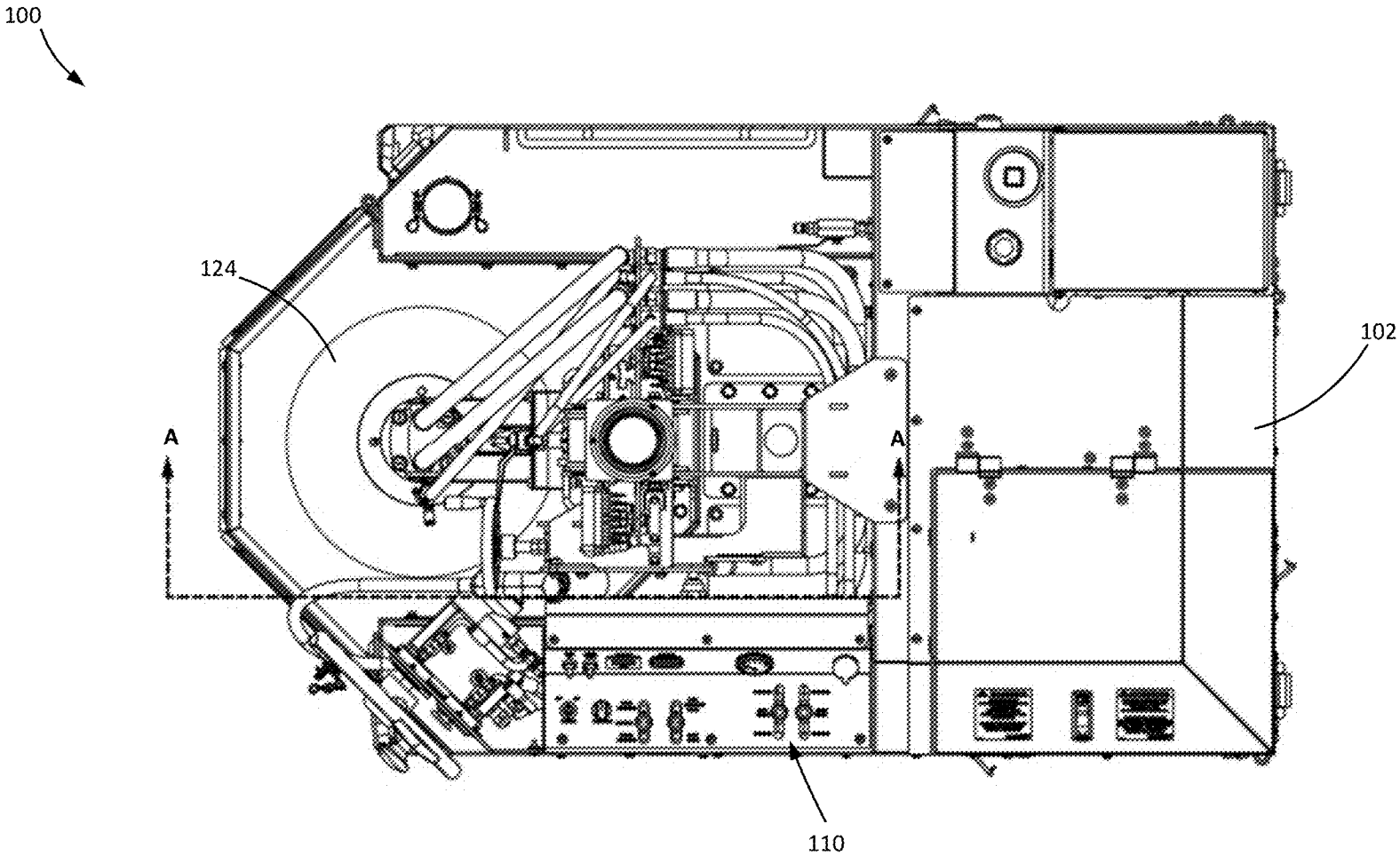
FIG. 7 is a top view of the apparatus of FIG. 1, shown with a core bit.

Referring to FIGS. 1-7, a mobile coring apparatus is shown generally at reference numeral 100. In the example illustrated, the apparatus 100 is self-propelled. The apparatus 100 has a machine frame 102. The machine frame 102 supports and contains various components of the apparatus 100. For example, a mobility assembly 104 may be coupled to the machine frame 102. The mobility assembly 104 is for moving the mobile coring apparatus 100 along a surface 101 (e.g., the ground, pavement, concrete, asphalt-concrete, sidewalks, roads, etc.) (see also FIG. 9A). The mobility assembly 104 may include at least one track system. For example, as shown in the example of FIG. 1, the mobility assembly 104 includes two track systems, with each positioned below and towards either lateral side of the mobile coring apparatus 100. In other examples, the mobility assembly 104 may include wheels or any other suitable assembly.

The machine frame 102 may support an engine 106, shown behind the engine door 108 in FIG. 1. The engine 106 may be used to drive the mobility assembly 104 and propel the mobile coring apparatus 100. The engine 106 may be controlled using controls 110. The controls 110 may be used to control the magnitude and direction of the propulsion of the mobile coring apparatus 100. The controls 110 may be manual controls mounted at any suitable position on the machine frame 102. For example, as shown in FIG. 1, the controls 110 are positioned at a lateral side of the mobile coring apparatus 100. In some examples, the controls 110 may include a remote control in addition to or in place of manual controls. The machine frame 102 may also support a steering wheel 111 used for steering the mobile coring apparatus 100. In some examples, the steering of the mobile coring apparatus 100 may be controlled using a remote control in place of or alternatively to the steering wheel 111.

Figure 8:
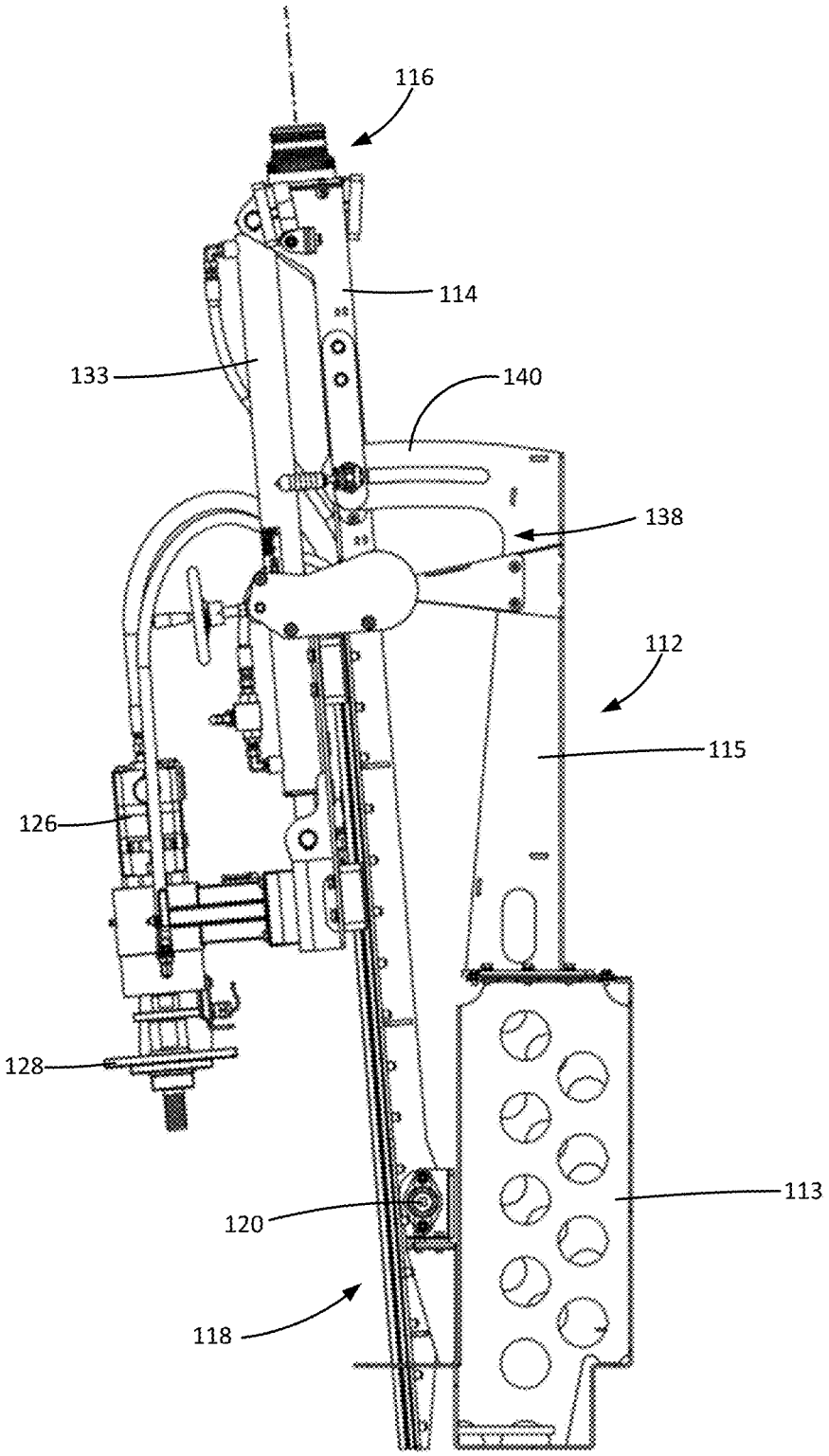
FIG. 8 is a right side view of a mast and a mount of the apparatus of FIG. 1.

Referring now to FIG. 8, the machine frame 102 includes a mount 112. The mount 112 may include a vertical stiffener 113 and an elongate plate 115 fixed to the vertical stiffener 113. The mobile coring apparatus 100 also includes a mast 114. The mast 114 is pivotally connected to the mount 112. The mast 114 is elongate and extends from a mast top end 116 to a mast lower end 118. As shown, for example in FIG. 8, the mast 114 may be pivotally connected to the mount 112 towards the mast lower end 118. The pivotal connection may be at the vertical stiffener 113 of the mount 112 (FIG. 8) or at the elongate plate 115. For example, in FIG. 8 the mast 114 is pivotally connected to the mount 112 at pivot point 120. The mast 114 may be pivotably connected to the mount 112 using any suitable mechanism, including but not limited to a shoulder socket screw, pin, or hinge.

Figure 9C:
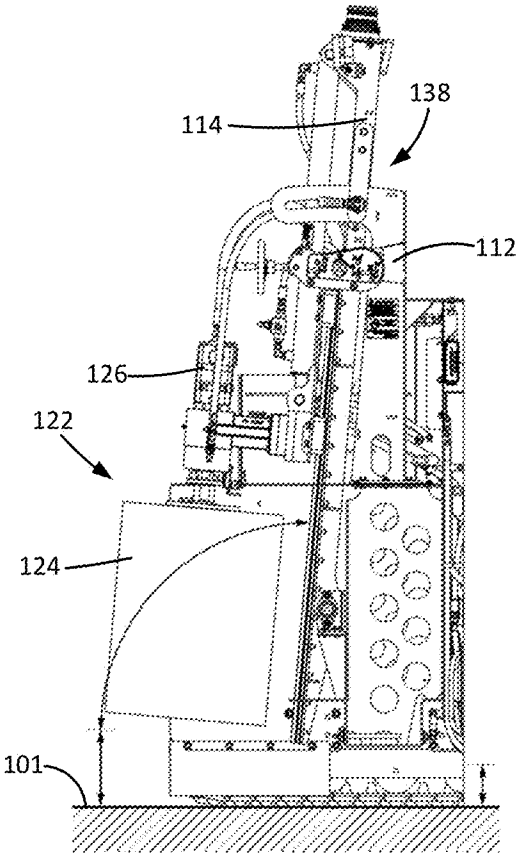
FIGS. 9A-9C are cross-sectional views taken along the line A-A in FIG. 7, with the mast of the apparatus in forward, intermediate and rearward positions, respectively.
Figure 9B:
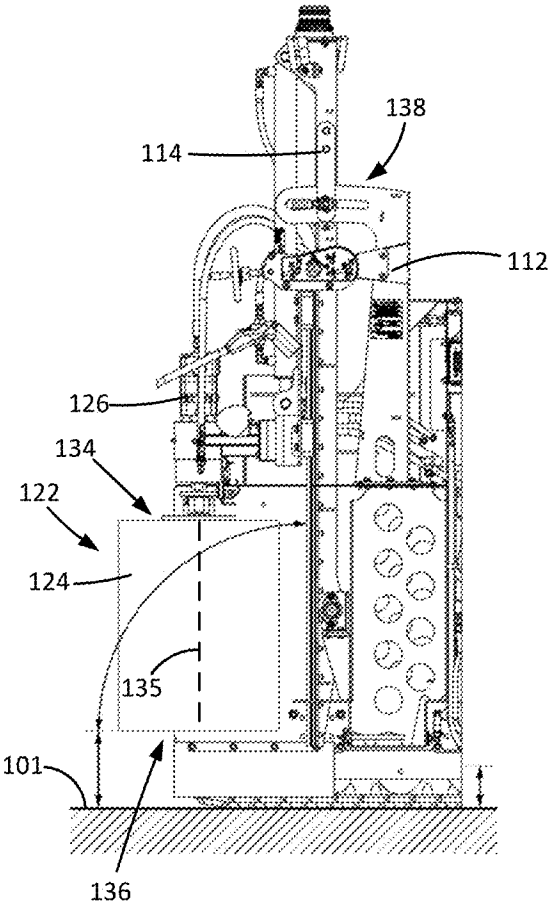
Figure 9A:
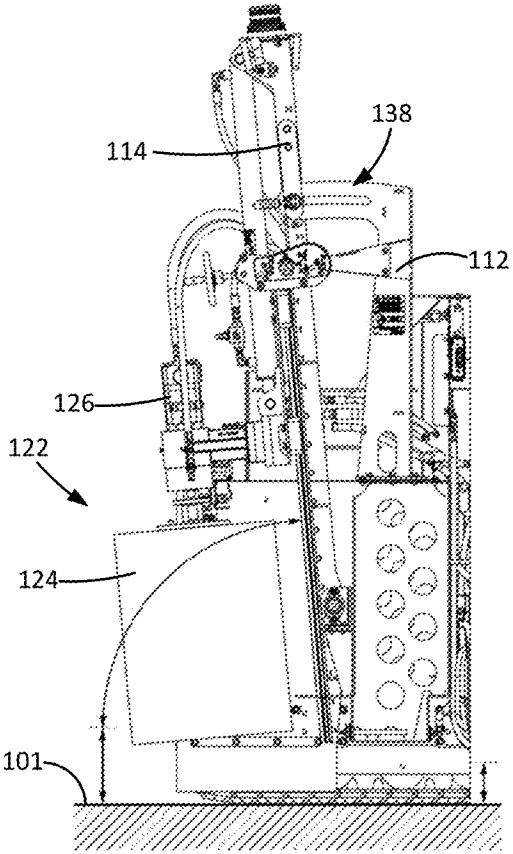

Referring to FIG. 9A, the mobile coring apparatus 100 further includes a coring assembly shown generally at 122. The coring assembly 122 is coupled to the mast 114. The coring assembly 122 is shown to include a core bit 124 for coring through a surface. The core bit 124 can be of various sizes and configurations. The coring assembly 122 may also include a motor 126 for rotatably driving the core bit 124. A rotary spindle 128 may connect the motor 126 and the core bit 124 and transfer rotational energy and thrust load therebetween (see FIG. 8). In operation, the motor 126 and the core bit 124 can be used to perform a cutting operation to penetrate a ground surface.

Figure 10:
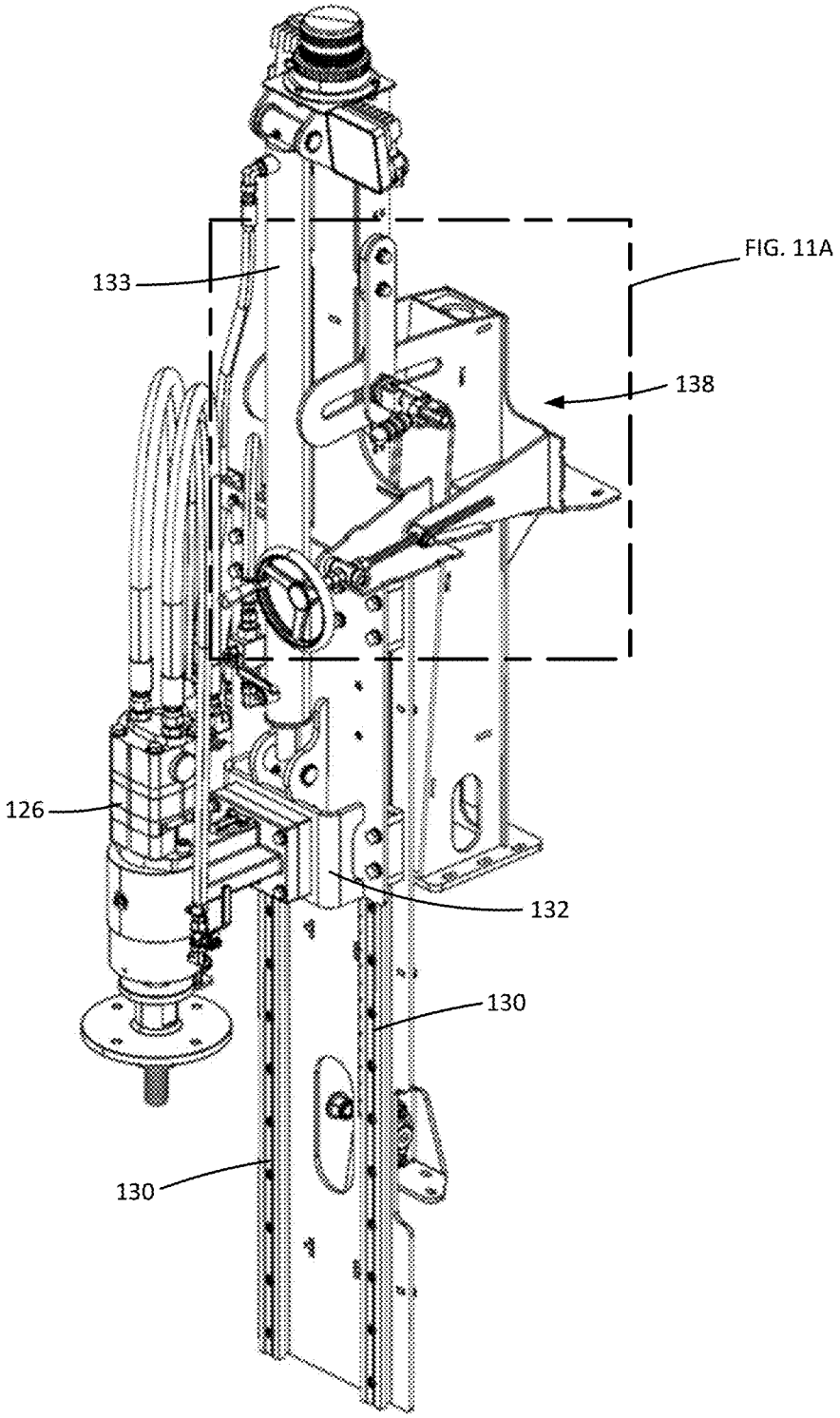
FIG. 10 is a front perspective view of a portion of the mast and mount of the apparatus of FIG. 1.

The mobile coring apparatus 100 can be configured so that the rotary spindle 128 may be translated relative to the mast 114 to adjust the positioning of the core bit 124 relative to the ground surface. In other words, the coring assembly 122 can be displaced upwardly and downwardly relative to the surface 101 between a raised position (i.e. with the core bit 124 away from the surface 101) and a lowered position (i.e. in operation, with the core bit 124 driven into the ground surface 101). To facilitate displacement of the coring assembly 122, the mast 114 may include one or more rails 130. For example, as shown in FIG. 10, the mast 114 may include two rails 130 that are parallel to one another. A bed (i.e. a platform) 132 may be slidingly mounted to the rails 130. The coring assembly 122 may be fixed to the bed 132. Therefore, in operation, the core bit 124, rotary spindle 128, motor 126, and bed 132 may be moved up and down along the rail(s) 130 as needed. For example, these components may be moved upwardly while the mobile coring apparatus 100 is moving between coring locations. Once the mobile coring apparatus 100 is in the proper location, these components may be moved down to perform the coring operation. The movement of the coring assembly 122 may be actuated using hydraulics, pneumatics, electricity or any other suitable means. For example, as shown in FIG. 10, the mast 114 may include a hydraulic cylinder 133. In other examples, the mast can include, for example but not limited to, a pneumatic cylinder or an electric actuator. The movement of the coring assembly 122 may be controlled using controls 110.

The mast 114 is configured to pivot relative to the mount 112 between a forward position (FIGS. 8 and 9A) and a rearward position (FIG. 9C). In the forward position, the mast 114 is titled forwardly. In other words, the mast top end 116 is pivoted away from mount 112 and the mast lower end 118 is pivoted towards mount 112. In the embodiment shown in FIGS. 8 and 9A, the mast 114 is tilted forwardly approximately 10 degrees to the vertical in the forward position. In other embodiments, the mast 114 could be titled forwardly anywhere from about 5-25 degrees in the forward position. In the rearward position, the mast top end 116 is pivoted towards mount 112 and the mast lower end 118 is pivoted away from mount 112. In the embodiment shown in FIG. 9C, the mast 114 is titled rearwardly approximately 10 degrees to the vertical in the rearward position. In other embodiments, the mast 114 could be titled rearwardly anywhere from about 5-25 degrees in the rearward position. The mast 114 may also pivot to any position between the forward and rearward positions, for example to an intermediate position as shown in FIG. 9B. In the intermediate position, an axis 135 that extends from a top end 134 of the core bit 124 to a lower end 136 of the core bit 124 is generally vertical to the surface 101. An advantage of a pivotable mast 114 is that the coring operation can always be performed at the ideal angle with the ground surface 101, including in situations where the mobile coring apparatus 100 is on an angled or uneven surface. No matter the angle of the surface 101, the core bit 124 can be kept generally vertical, perpendicular to the horizon.

The mobile coring apparatus 100 may also include an angular adjustment mechanism 138. The angular adjustment mechanism 138 may permit the mast 114 to pivot between the forward and rearward positions and lock the mast 114 in place relative to the mount 112. In particular, the angular adjustment mechanism 138 is operable to lock the mast 114 in the forward position, the rearward position, or any intermediate position between the two (e.g., the intermediate position shown in FIG. 9B). The angular adjustment mechanism 138 may secure the mast 114 in place towards the mast top end 116. The angular adjustment mechanism 138 includes a side plate 140 that extends horizontally outwardly from one of the mast 114 and mount 112. In some examples, the side plate 140 extends horizontally outwardly from the mount 112 (i.e. extending towards the mast 114). In particular, the side plate is formed at one end of elongate plate 115.

Figure 11A:
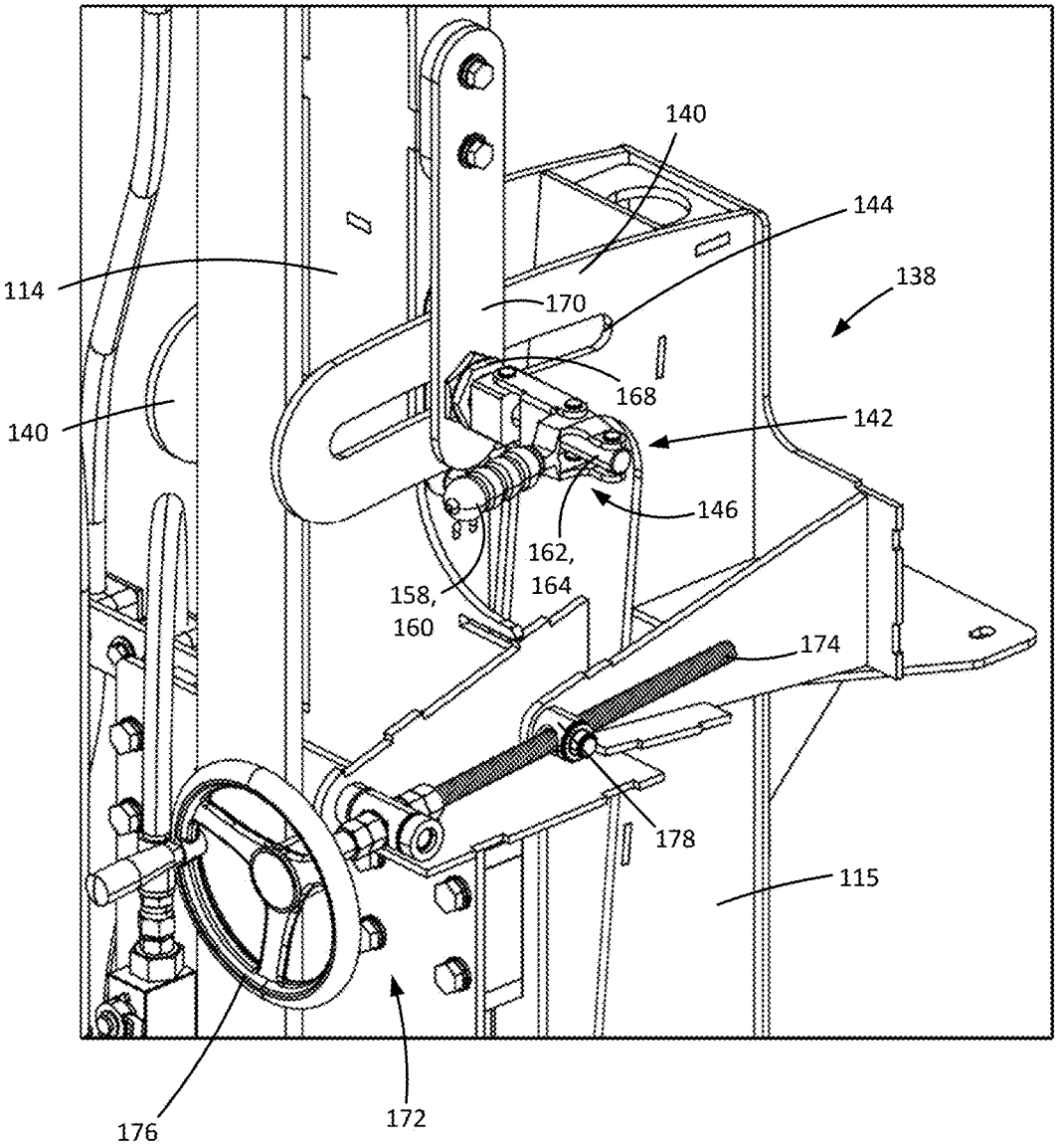
FIG. 11A is an enlarged view of a portion of FIG. 10.

The angular adjustment mechanism 138 may also include a locking mechanism 142 mounted to the other of the mast 114 and mount 112. In other words, if the side plate 140 extends from the mast 114, the locking mechanism 142 is mounted to the mount 112. If the side plate 140 extends from the mount 112 (as shown in FIG. 11A), the locking mechanism 142 is mounted to the mast 114. The locking mechanism 142 may be any mechanism for locking the mast 114 in position relative to the mount 112.

In some examples, the locking mechanism 142 includes an arcuate slot 144 in the side plate 140. The slot 144 may receive a clamping mechanism 146. The clamping mechanism 246 may be any suitable mechanism for clamping the mount 112 to the mast 114.

Figure 11B:
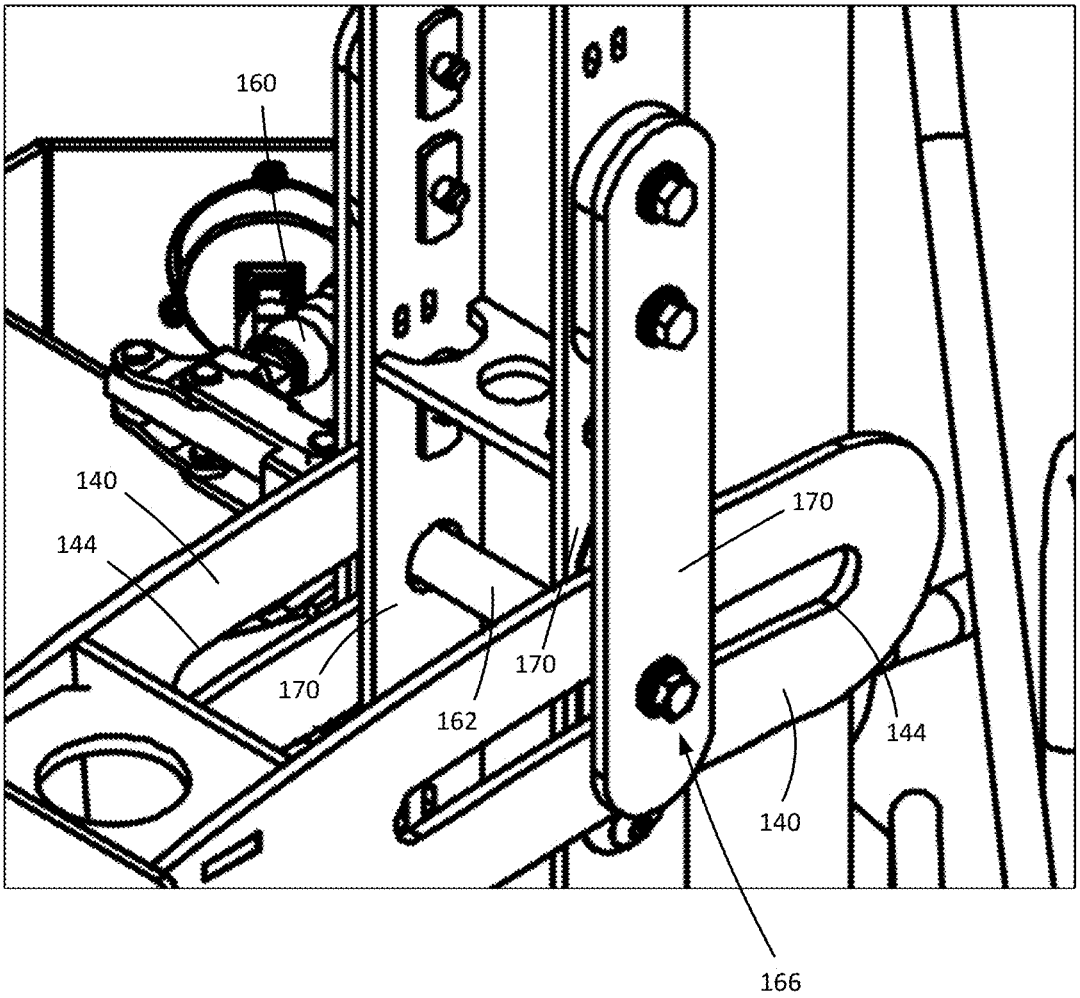
FIG. 11B is an enlarged rear perspective view of an angular adjustment mechanism of the apparatus of FIG. 1.
Figure 12:
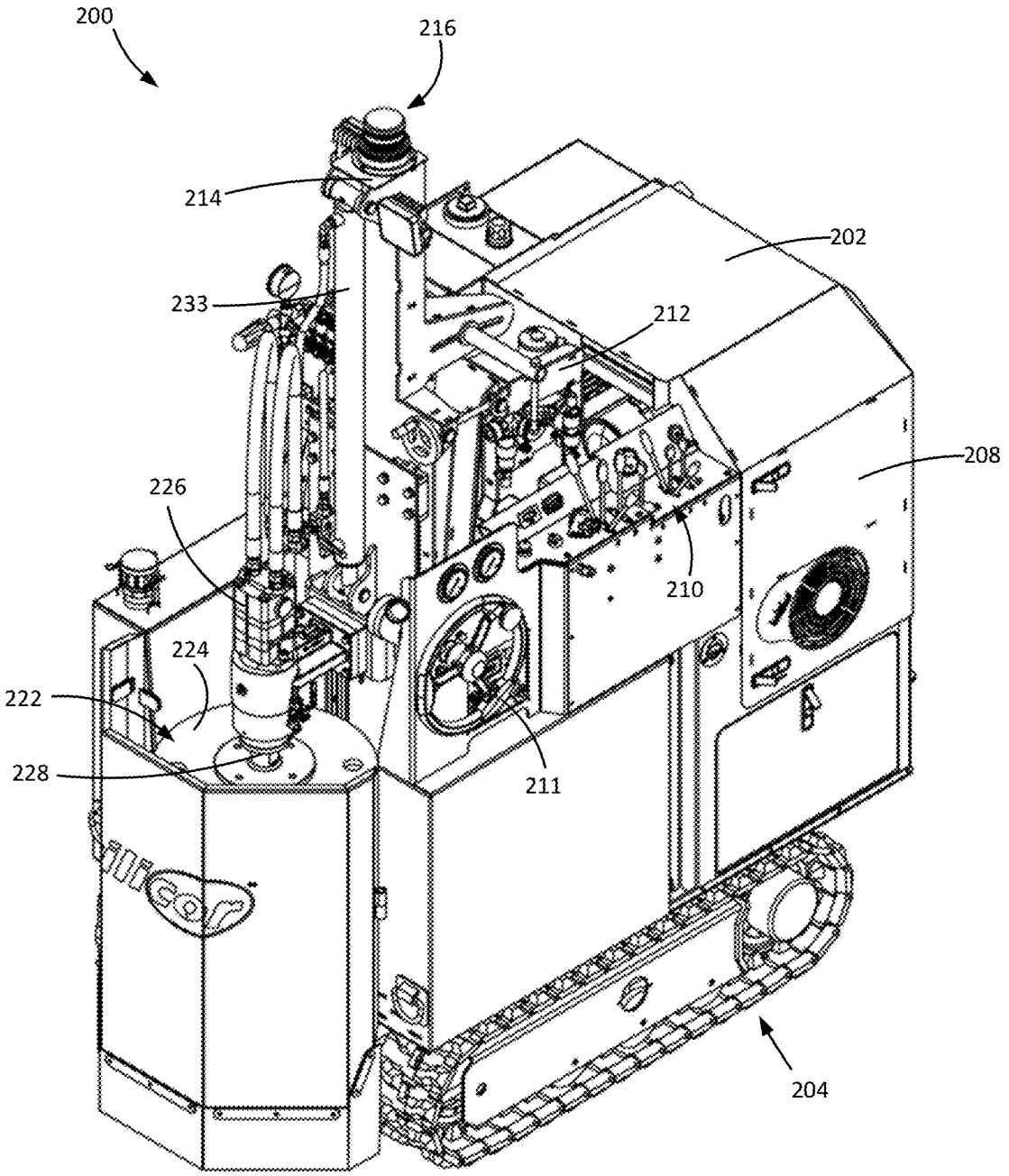
FIG. 12 is a front perspective view of another exemplary mobile coring apparatus.
Figure 13:
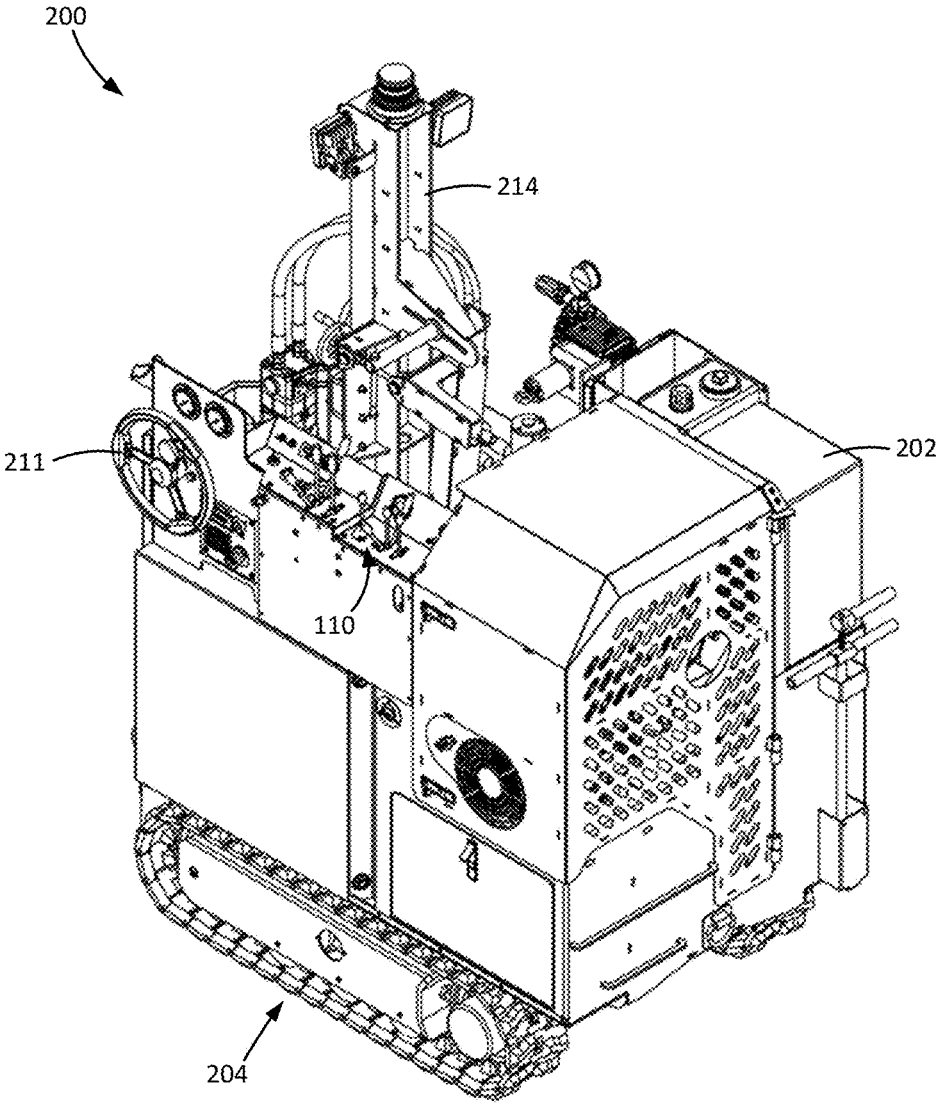
FIG. 13 is a rear perspective view of the apparatus of FIG. 12.

In the example shown in FIG. 11A, the clamping mechanism 146 includes a toggle clamp 158. The toggle clamp 158 includes a toggle 160 and bar 162. The toggle 160 is rotatingly connected to the bar 162 at a bar outer end 164. The bar also has a bar inner end 166 (FIG. 11B) and may be at least partially threaded. The toggle clamp 158 has a toggle base 168. The clamping mechanism 146 may have various configurations such that when the toggle 160 is rotated from an unlocked position to a locked position, the toggle base 168 is forced towards the side plate 140 and clamps the side plate 140 to the mast 114. In the example shown in FIGS. 11A and 11B, the mount 112 has two side plates 140, each with a slot 144. The side plates 140 are spaced apart from each other such that the mast 114 may generally fit between the side plates 140. The mast 114 may also contain one or more vertical sections 170 having apertures through which the bar 162 may fit through. For example, the mast 114 shown in FIGS. 11A and 11B has four vertical sections 170. Each of the side plates 140 fits between two of the vertical sections 170. The bar 162 goes through each of the four vertical sections 170 and the two side plates 140. The bar 162 may be secured in place at the bar inner end 166 (e.g., with a nut). In operation, when the toggle 160 is moved into the locked position, the bar 162 is pulled away from the mast 114, while the toggle base 168 is pushed towards a vertical section 170 of the mast. This compresses the vertical sections 170 and side plates 140 together, locking the mast 114 in position relative to the mount 112.

The angular adjustment mechanism 138 may also include a pivot wheel assembly 172. The pivot wheel assembly 172 may be used to adjust the position of the mast 114 relative to the mount 112. In operation, the clamping mechanism 146 can be placed in an unlocked position, and the pivot wheel assembly 172 can be operated to move the mast 114 relative to the mount 112. Once in the desired position, the clamping mechanism 146 can be placed in a locked position.

The pivot wheel assembly 172 may have any configuration suitable for moving the mast 114 relative to the mount 112. In the example shown in FIGS. 11A and 11B, the pivot wheel assembly 172 includes a pivot rod 174 and a pivot wheel 176. The pivot rod 174 extends between the mast 114 and the mount 112 (i.e. from the mast 114 to the mount 112). The pivot rod 174 may be at least partially threaded. The pivot rod 174 may be supported on the mast 114 and connected to a pivot rod connector 178 (e.g., a threaded connection) mounted on the mount 112. The pivot wheel 176 is operable to rotate the pivot rod 174. As the pivot wheel 176 rotates, the pivot rod 174 rotates and moves through the pivot rod connector 178, in turn moving the mast 114 relative to the mount 112.

Reference is now made to FIGS. 12-16 which show another example mobile coring apparatus 200. Mobile coring apparatus 200 is similar to mobile coring apparatus 100, with elements having similar structure and/or performing similar function indicated with reference numerals incremented by 100.

In the example illustrated, mobile coring apparatus 200 has a machine frame 202. A mobility assembly 204 is coupled to the machine frame 202. The machine frame 202 may support an engine (not shown) behind an engine door 208. The engine may be controlled using controls 210. The machine frame 202 also supports a steering wheel 211.

Figure 14:
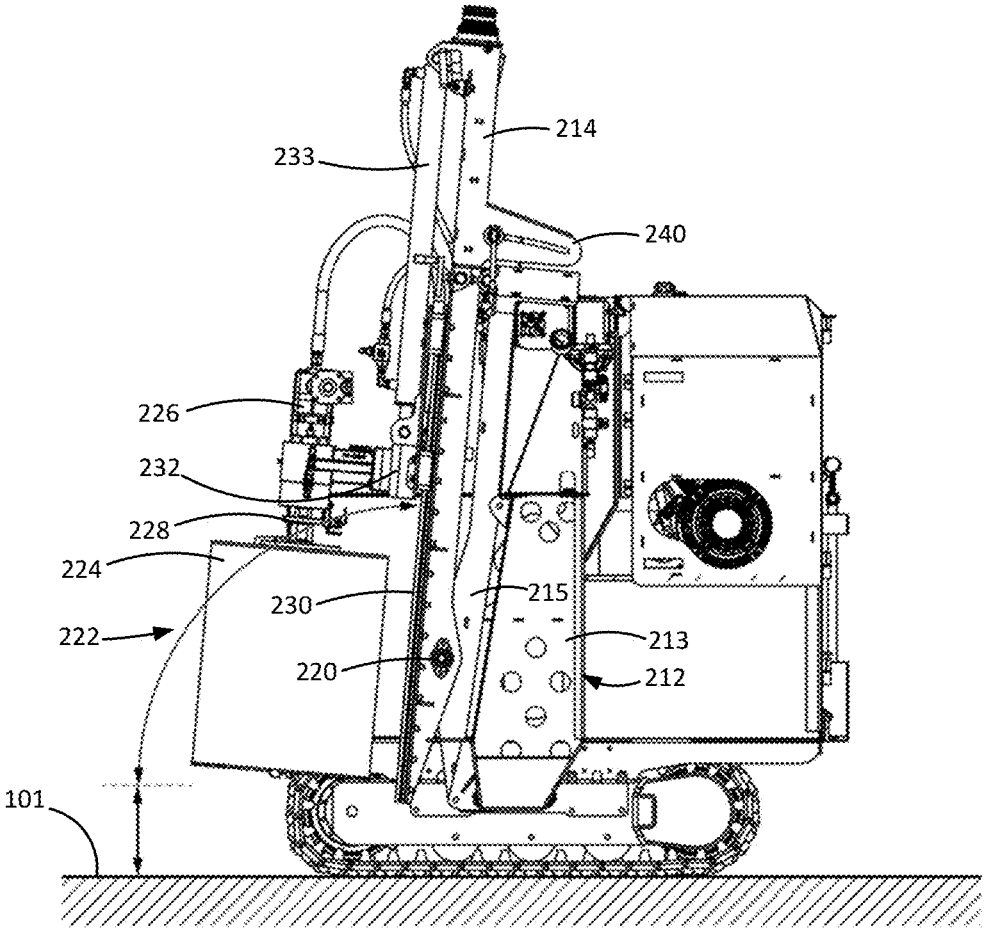
FIG. 14 is a right side view of the apparatus of FIG. 12, shown with some components removed to give a better view.

Referring to FIG. 14, the mobile coring apparatus 200 further includes a mount 212. The mount 212 includes a vertical stiffener 213 and an elongate plate 215 fixed to the vertical stiffener 213. The mobile coring apparatus 200 also includes a mast 214. The mast 214 is pivotably connected to the mount 112 at pivot point 220. In this example, the pivotal connection between the mast 214 and the mount 212 is at the elongate plate 215. FIG. 14 shows the mast 114 in a rearward position. The mast may also include rails 230 and a platform 232, as well as a hydraulic cylinder 233.

The mobile coring apparatus 200 also includes a coring assembly 222. The coring assembly 222 includes a core bit 224, a motor 226 and a rotary spindle 228.

Figure 15:
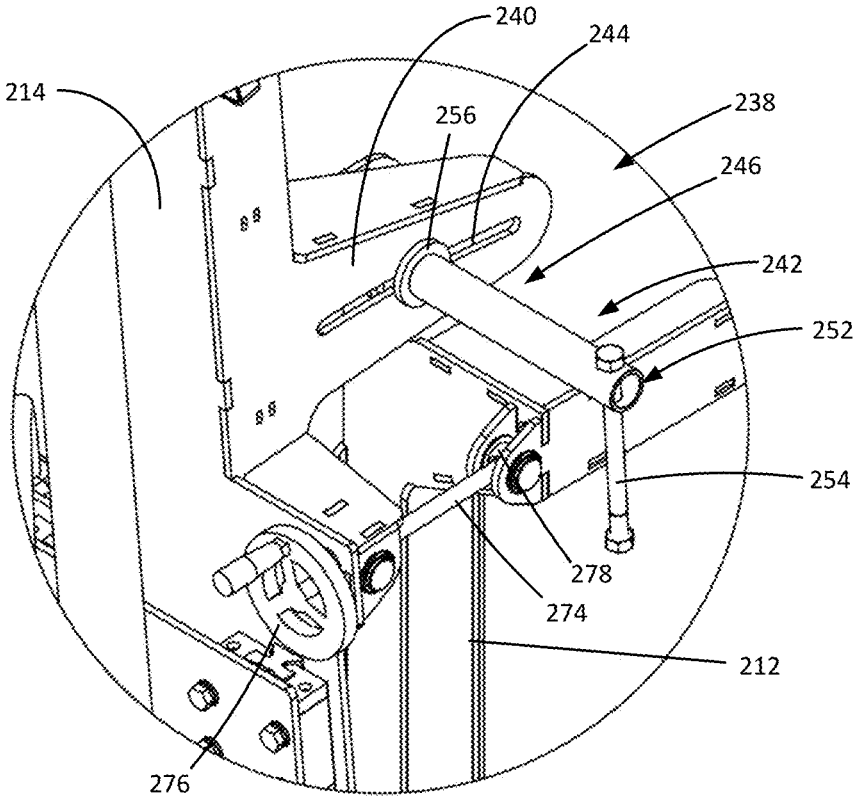
FIG. 15 is an enlarged perspective view of an angular adjustment mechanism of the apparatus of FIG. 12.
Figure 16:
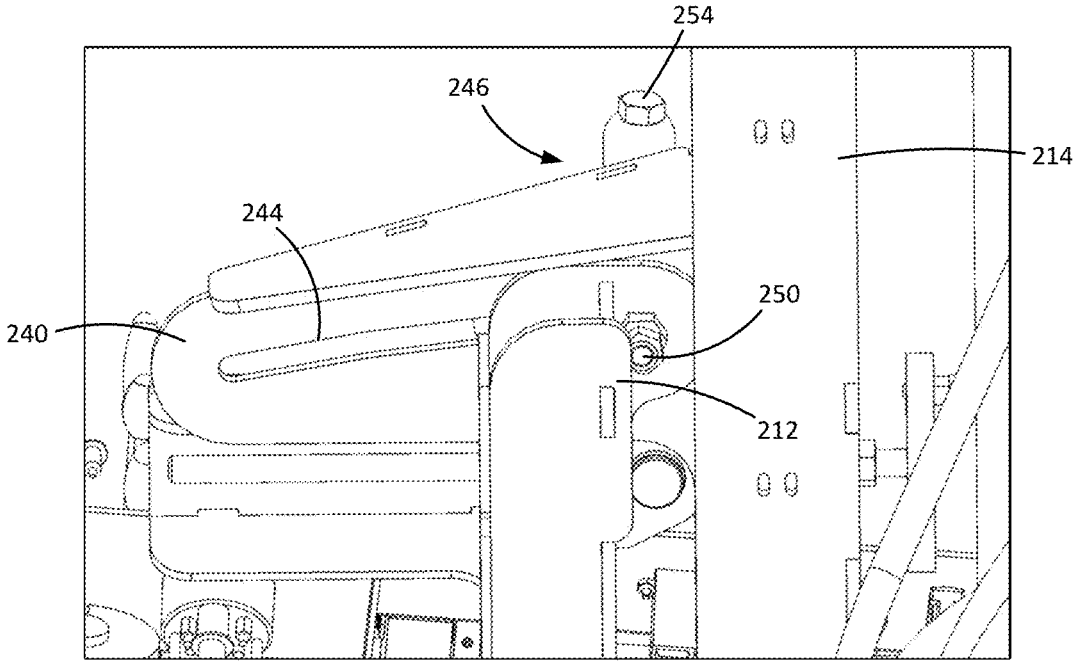
FIG. 16 is a left side enlarged view of the angular adjustment mechanism of the apparatus of FIG. 12.

Referring to FIGS. 15 and 16, the mobile coring apparatus 200 further includes an angular adjustment mechanism 238. The angular adjustment mechanism 238 includes a side plate 240. In this example, the side plate 240 extends horizontally outwardly from the mast 214 (i.e. extending towards the mount 212).

The angular adjustment mechanism 238 also includes a locking mechanism 242. In this example, the locking mechanism 242 is mounted to the mount 212. The locking mechanism 242 includes an arcuate slot 244 in the side plate 240. The side plate 240 receives a clamping mechanism 246.

In the example shown in FIGS. 15 and 16, the clamping mechanism 246 include a clamp tube 248. The clamp tube 248 may be any suitable tube and may be at least partially threaded. The clamp tube 248 may extend through the slot 244 and the mount 212 or mast 214. In the example shown in FIGS. 15 and 16, the clamp tube 248 extends through the slot 244 in the mast 214 as well as through an aperture in the mount 212. An inner end 250 of the clamp tube 248 (see FIG. 16) can be secured in place (e.g., with a nut). The outer end 252 of the clamp tube 248 may have a bolt 254 slidingly engaged with the clamp tube 248. The clamp tube 248 may also have a base 256 towards the outer end 252 that abuts the side plate 240 in operation. Rotation of the bolt 254 rotates the clamp tube 248, which in turn forces the base 256 towards the side plate 240 and clamps the mast 214 to the mount 212.

The angular adjustment mechanism 238 may also include a pivot wheel assembly 272, having a pivot rod 274 and a pivot wheel 276. The pivot rod may be supported on the mast 214 and connected to a pivot rod connector 278 mounted on the mount 212.

In addition to the features described above, the machine frame 102, 202 may include various doors or shells for protecting and containing components of the mobile coring apparatus 100, 200. The mobile coring apparatus 100, 200 may also include various other elements such as lights, fans, controls, switches, motors, tanks, pumps, etc. as necessary.

In operation, the mobile coring apparatus 100, 200 is moved to a desired location using the controls 110, 210. While moving, the coring assembly 122, 222 is raised away from the ground and the clamping mechanism 146, 246 is in a locked position. Once in position, the clamping mechanism 146, 246 is put in an unlocked position, and the pivot wheel assembly 172, 272 is used to pivot the mast 114, 214 into a position whereby the core bit 124, 224 is perpendicular to the horizon. Once in position, the clamping mechanism 146, 246 is moved back into the locked position. The motor 126, 226 is then actuated to rotate the core bit 124, 224, and the bed 132, 232 is moved downwardly such that the core bit 124, 224 makes contact with and cuts into the ground. Once the coring is completed, the bed 132, 232 is moved back upwardly along the rails 130, 230 to remove the core bit 124, 224 from the ground.

While the above description provides examples of one or more apparatuses or methods, it will be appreciated that other apparatuses or methods may be within the scope of the accompanying claims.

We claim:

1. A mobile coring apparatus, comprising:

a machine frame comprising a mount;

a mast pivotally connected to the mount; and a coring assembly coupled to the mast, the coring assembly configured to drive a core bit for coring through a surface, wherein the mast is configured to pivot relative to the mount between a forward position and a rearward position, wherein the mast extends from a mast top end to a mast lower end, and the mast is pivotally connected to the mount towards the mast lower end, comprising an angular adjustment mechanism that permits the mast to pivot between the forward and rearward positions and locks the mast in place relative to the mount, and wherein the angular adjustment mechanism comprises a pivot wheel assembly, the pivot wheel assembly comprising:

a pivot rod extending between the mast and the mount; and a pivot wheel operable to rotate the pivot rod, wherein the rotation of the pivot rod pivots the mast about the mount.

2. The apparatus of claim 1, wherein the angular adjustment mechanism is operable to lock the mast in the forward position, the rearward position, and an intermediate position, wherein, in the intermediate position, an axis extending from a core bit top end to a core bit lower end is generally vertical to the surface.

3. The apparatus of claim 2, wherein the angular adjustment mechanism comprises a side plate that extends horizontally outwardly from one of the mast and mount.

4. The apparatus of claim 3, wherein the angular adjustment mechanism comprises a locking mechanism mounted to the other of the mast and mount that locks the other of the mast and mount to the side plate.

5. The apparatus of claim 4, wherein the locking mechanism comprises an arcuate slot in the side plate for receiving a clamping mechanism.

6. The apparatus of claim 5, wherein the clamping mechanism comprises a toggle clamp or a clamp tube.

7. The apparatus of claim 1, wherein the mast extends from a mast top end to a mast lower end, and the angular adjustment mechanism secures the mast in place towards the mast top end.

8. The apparatus of claim 1, wherein the mast is pivotably connected to the mount using one of a shoulder socket screw, a pin or a hinge.

9. The apparatus of claim 1, wherein the mast comprises at least one rail that permits the coring assembly to be displaced upwardly and downwardly relative to the surface between a raised position and a lowered position.

10. The apparatus of claim 9, wherein the mast comprises two rails that are parallel to one another.

11. The apparatus of claim 10, wherein the mast comprises a bed that is slidingly mounted to the rails and the coring assembly is fixed to the bed.

12. The apparatus of claim 11, comprising a motor for displacing the coring assembly along at least one of the rails.

13. The apparatus of claim 1, wherein the apparatus is self-propelled.

14. The apparatus of claim 13, comprising a mobility assembly coupled to the machine frame for moving the apparatus along the surface.

15. The apparatus of claim 14, wherein the mobility assembly comprises at least one track system.

16. The apparatus of claim 15, comprising an engine for propelling the mobile coring assembly and a remote control for controlling the magnitude and direction of the propulsion of the mobile coring apparatus.

* * * * *